US010502398B2

(12) United States Patent
Toft

(10) Patent No.: US 10,502,398 B2
(45) Date of Patent: Dec. 10, 2019

(54) LIGHT FIXTURE HOUSING WITH INTEGRATED FASTENING ELEMENT

(71) Applicant: Harman Professional Denmark ApS, Aarhus N (DK)

(72) Inventor: Uffe Kjaegaard Toft, Hojberg (DK)

(73) Assignee: HARMAN PROFESSIONAL DENMARK APS, Aarhus N (DK)

( * ) Notice: Subject to any disclaimer, the term of this patent is extended or adjusted under 35 U.S.C. 154(b) by 0 days.

(21) Appl. No.: 15/764,813

(22) PCT Filed: Oct. 3, 2016

(86) PCT No.: PCT/DK2016/050318

§ 371 (c)(1),
(2) Date: Mar. 29, 2018

(87) PCT Pub. No.: WO2017/063653

PCT Pub. Date: Apr. 20, 2017

(65) Prior Publication Data

US 2018/0274765 A1 Sep. 27, 2018

(30) Foreign Application Priority Data

Oct. 12, 2015 (DK) ..... 2015 70652

(51) Int. Cl.
*F21V 21/088* (2006.01)
*F21S 8/00* (2006.01)
(Continued)

(52) U.S. Cl.
CPC ..... *F21V 21/088* (2013.01); *F21S 8/03* (2013.01); *F21V 21/00* (2013.01); *F21W 2131/406* (2013.01); *F21Y 2115/10* (2016.08)

(58) Field of Classification Search
USPC ..... 248/205.1
See application file for complete search history.

(56) References Cited

U.S. PATENT DOCUMENTS 3,527,437 A * 9/1970 Lippman ..... G03B 15/03 248/205.1
4,527,224 A * 7/1985 Sangiamo ..... F16M 11/08 362/269

(Continued)

FOREIGN PATENT DOCUMENTS

DE 20312287 U1 11/2003
GB 2362442 A 11/2001

(Continued)

OTHER PUBLICATIONS http://web.archive.org/web/20150812194534/http://www.nimda-events.de/artikel/involight-mh127s/, Involight MH127S Moving Head mieten—Nimda-Events, dated Aug. 12, 2015, 2 pages.

*Primary Examiner* — Monica E Millner
(74) *Attorney, Agent, or Firm* — Brooks Kushman P.C.

(57) ABSTRACT

An attachment assembly integrated into the lamp housing and comprising an alcove formed in an outer surface of the housing shell, wherein the alcove is configured to accommodating a fastening unit, the fastening unit is configured to receive a mating member connected to a support structure and the mating member can be locked to the fastening unit, wherein the fastening unit is secured to the housing shell by a self-tapping screw configured drill itself into a part of said polymer housing shell. The invention relates also to an assembly unit where the alcove is formed as a stepped bottom where a mating recess forms the deepest bottom part, a support recess forms the middle bottom part and the alcove bottom forms an upper bottom part.

18 Claims, 6 Drawing Sheets

(51) Int. Cl.

| | |
|---|---|
| ***F21V 21/00*** | (2006.01) |
| *F21W 131/406* | (2006.01) |
| *F21Y 115/10* | (2016.01) |

(56) References Cited

U.S. PATENT DOCUMENTS 4,628,415 A * 12/1986 Vescio ..... B60Q 1/2615 362/548
4,972,301 A 11/1990 Kasboske
5,205,633 A * 4/1993 Kasboske ..... B60Q 1/0483 362/368
5,779,350 A * 7/1998 Chang ..... B25H 3/02 362/154
6,123,441 A * 9/2000 Kasboske ..... F21V 21/005 362/249.01
6,135,624 A 10/2000 Masters et al.
6,283,600 B1 9/2001 Levasseur
6,283,617 B1 9/2001 Stekelenburg
6,443,605 B1 * 9/2002 Kasboske ..... B60Q 1/2611 362/287
6,481,871 B2 * 11/2002 Jamison ..... F21V 21/30 362/287
7,150,542 B1 * 12/2006 Russello ..... F21S 8/033 362/285
7,841,755 B1 * 11/2010 Walker ..... F21V 21/02 362/147
2008/0186729 A1 * 8/2008 Madden ..... B60Q 1/0483 362/546

FOREIGN PATENT DOCUMENTS

KR 100949452 B1 3/2010
KR 101013208 B1 2/2011

* cited by examiner

LIGHT FIXTURE HOUSING WITH INTEGRATED FASTENING ELEMENT

CROSS-REFERENCE TO RELATED APPLICATIONS

This application is the U.S. national phase of PCT Application No. PCT/DK2016/050318 filed on Oct. 3, 2016, which claims priority to DK Patent Application No. PA201570652 filed on Oct. 12, 2015, the disclosures of which are incorporated in their entirety by reference herein.

FIELD OF THE INVENTION

The present invention relates to mechanical parts of a light fixture comprising lamp housing wherein a light source, electrical components and optical components are arranged, such that light is emitted out of the housing. The present invention relates specifically to a fastening assembly used at a light fixture housing.

BACKGROUND OF THE INVENTION

Light fixtures are commonly known in the art of lighting and especially used in entertainment lighting. Typically, a light fixture comprises a lamp housing wherein at least one light source, electrical components and optical components are arranged, such that light is emitted out of the housing. The competition in the market of light fixtures has traditionally been based on the optical performance of the light fixtures such as light output, number of light effects, color mixing etc. The competition in the market has lately changed such that parameters such as quality, serviceability and price have become more important factors. There is thus a need for a competitive light fixture with regard to quality, serviceability, and price.

In addition to the lamp housing and the components arranged therein, the light fixture may be provided with elements making it possible to arrange the light fixture as desired, such as mounting plates, brackets or fastening elements for arranging the light fixture to a structure such as a lighting truss or a building; or legs or support elements for arranging the light fixture at the ground.

U.S. Pat. No. 6,135,624 discloses a universal mounting plate for luminaire fixture. The mounting plate is formed generally as a flat body having integral portions formed out of plane to provide particular mounting functions. The unit fixtures per se mount directly to the mounting plate through engagement of openings formed on rear walls of the unit fixtures with free legs of bayonet mounts extending from a face of the mounting plate. The plate is snap-locked in certain embodiments to the fixtures, and a locking mechanism is actuated on full engagement of the bayonet mounts to positively hold the unit fixtures to the mounting plate.

U.S. Pat. No. 6,283,617 discloses a bracket structure for halogen light, which is made from a strip plate body by folding. A plurality of holes and slots are provided on the folded plates to enable mounting the bracket to an article in a variety of positions.

U.S. Pat. No. 4,972,301 discloses a vehicle headlamp consisting of a casing containing an illumination source, a bracket for connection to a vehicle, and a structure for selectively attaching the bracket to the casing at different locations on the casing to facilitate connection of the casing to various style vehicles.

GB 2 362 442 discloses a locking device for preventing rotation of a bolt or nut relative to a workpiece and has a hexagonal hole into which a head of the bolt or nut fits and a clearance hole through which a bolt shaft can pass. The device engages an edge of the workpiece so that the bolt or nut cannot rotate relative to the workpiece.

DESCRIPTION OF THE INVENTION

The object of the present invention is to solve the above described limitations related to prior art and to provide a low-cost light fixture housing with strong and reliable fastening elements. This is achieved by a light fixture as described in the independent claims. The dependent claims describe possible embodiments of the light fixture. The advantages and benefits of the present invention are described in the detailed description of the invention.

DETAILED DESCRIPTION OF THE INVENTION

The present invention is described in view of exemplary embodiments intended to illustrate the principles of the present invention. The skilled person will be able to provide several embodiments within the scope of the claims. In the illustrated embodiments, the illustrated light beams and optical components only serve to illustrate the principles of the invention rather than illustrating exact and precise light beams and optical components. Throughout the description the reference numbers of similar elements providing similar effects have been given the same last two digits.

Figure 1A:
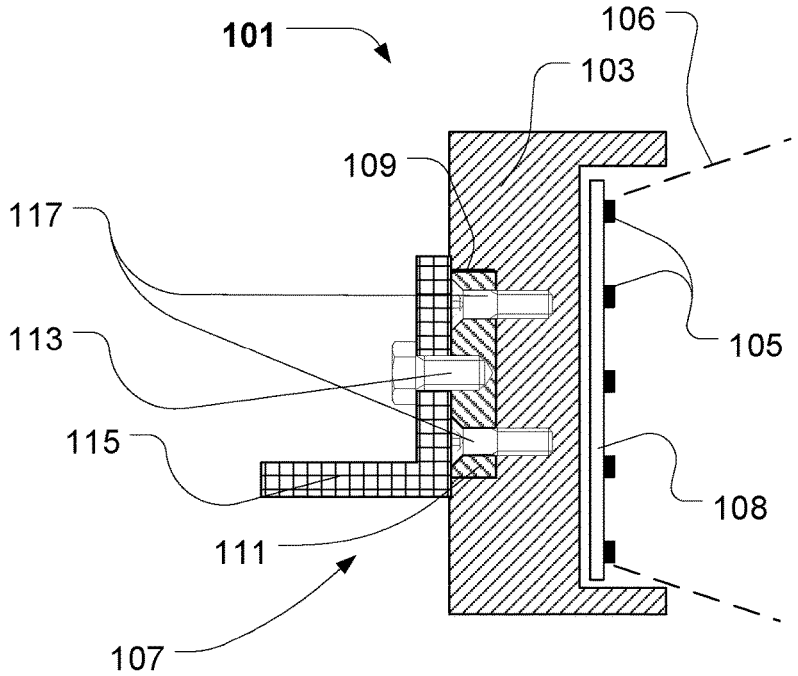
FIGS. 1A-B illustrate a structural cross sectional and an exploded cross sectional view of a light fixture comprising an attachment assembly according to the present invention.
Figure 1B:
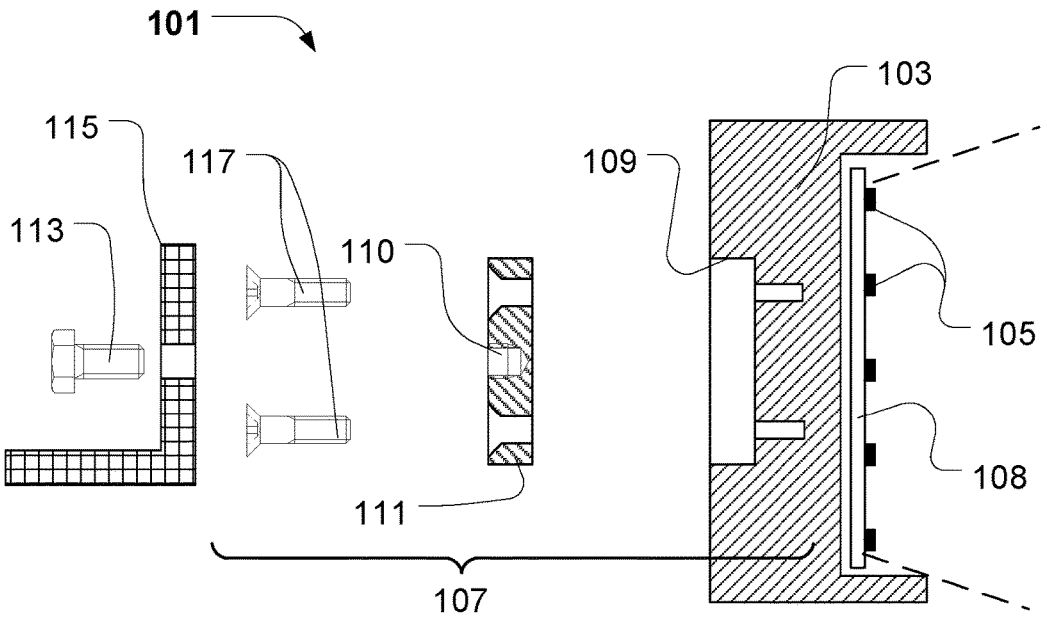

FIGS. 1A-B illustrate a structural cross sectional and an exploded cross sectional view of a light fixture 101 includes an attachment assembly 107 according to the present invention. The light fixture 101 includes a lamp housing having a polymer housing shell 103 forming a cavity 104, wherein at least one light source 105 is arranged. In the illustrated embodiment, the light source has been provided as a plurality of light emitting diodes (LEDs), (illustrated as black quadrangles) arranged on a LED printed circuit board (PCB) 108 and the LEDs have been configured to emit light 106 (illustrated as dashed lines) out of the lamp housing. The light source 105 can be provided as any kind of LEDs such as solid state LEDs, organic light emitting diodes (OLEDs) or polymer light emitting diodes (PLEDs); additionally the light source 105 can also be provided as discharge lamps, arc lamps, fluorescence lamps, plasma lamps, lasers or phosphor based light emitters.

The lamp housing comprises an attachment assembly 107 including an alcove 109 formed in the outer surface of the polymer housing shell 103. The alcove 109 is configured to accommodate a fastening unit 111 and the fastening unit 111 is to receive a mating member 113 of a support structure 115. The mating member 113 can be locked to the fastening unit 111 and the fastening unit 111 is secured to the polymer housing shell by at least one self-tapping screw 117 configured to drill itself into a part of the polymer housing shell 103. The alcove 109 forms a recess, a small and/or enclosed extension to the housing shell 103.

In the illustrated embodiment, the fastening unit 111 has been provided as a fastening plate 80 configured to fit into the alcove 109 and as a consequence the side walls of the alcove 109 will support the fastening plate and provide a stable arrangement of the fastening plate at the polymer housing. Thus, the fastening unit 111 is prevented from being rotated inside the alcove 109 and the light fixture 101 can thus be kept at the same position in relation to support structure 115. The fastening plate is secured to the polymer housing shell 103 using self-tapping screws and as a result the fastening unit 111 is secured in a tight position to the polymer-housing. Additionally, using self-tapping screws reduces the manufacturing costs as no additional metal attaching structures are needed to be provided to the polymer housing shell 103. This also reduces the weight of the light fixture 101. The fact that the fastening units are configured to fit into the alcove 109 makes is possible to use self-tapping screws as the alcove 109 facilitates support of the fastening unit 111.

In the illustrated embodiment, the mating member 113 is provided as a bolt having a hex head and the fastening plate comprises a threaded hole 110 wherein the bolt can be screwed. It is noticed that the bolt can have any kind of head enabling it to be screwed into the threaded hole 110. The support structure 115 is illustrated as a rectangular bracket, however it is to be understood that the support structure 115 can be any kind of support structure capable of supporting the light fixture 101. For instance, the support structure 115 can be a bracket comprising additional aspects, such as hooks, clamps, omega brackets, for attaching the light fixture 101 to other structures, such as a stage truss or a building structure.

In the illustrated embodiment, the depth of the alcove 109 is configured to accommodate the fastening unit 111 as a consequence the fastening unit 111 is entirely kept inside the alcove 109 which ensures that all side surfaces of the fastening unit are supported by the side walls of the alcove 109. Additionally, the alcove 109 has been provided as a recess in the polymer housing shell 103 and the surface of the polymer housing wherein the fastening assembly as provided appears thus as a flat surface and the light fixture 101 can thus be attached close to the bracket and the size of the support structure 115 can also be larger than the fastening assembly. As a consequence, different kinds of support structures 115 can be used to support the light fixture 101.

Figure 2A:
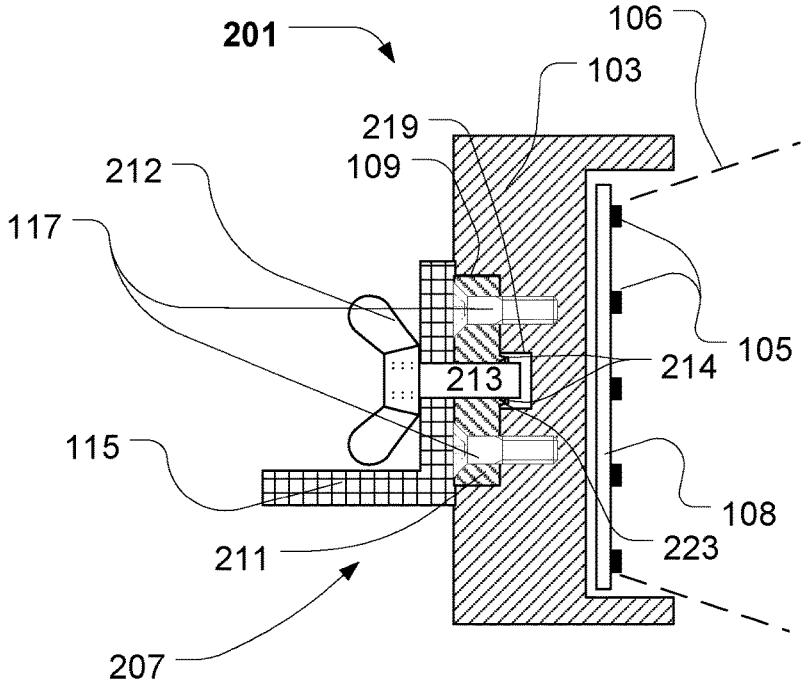
FIGS. 2A-B illustrate a structural cross sectional and an exploded cross sectional view of a light fixture comprising an attachment assembly according to the present invention.
Figure 2B:
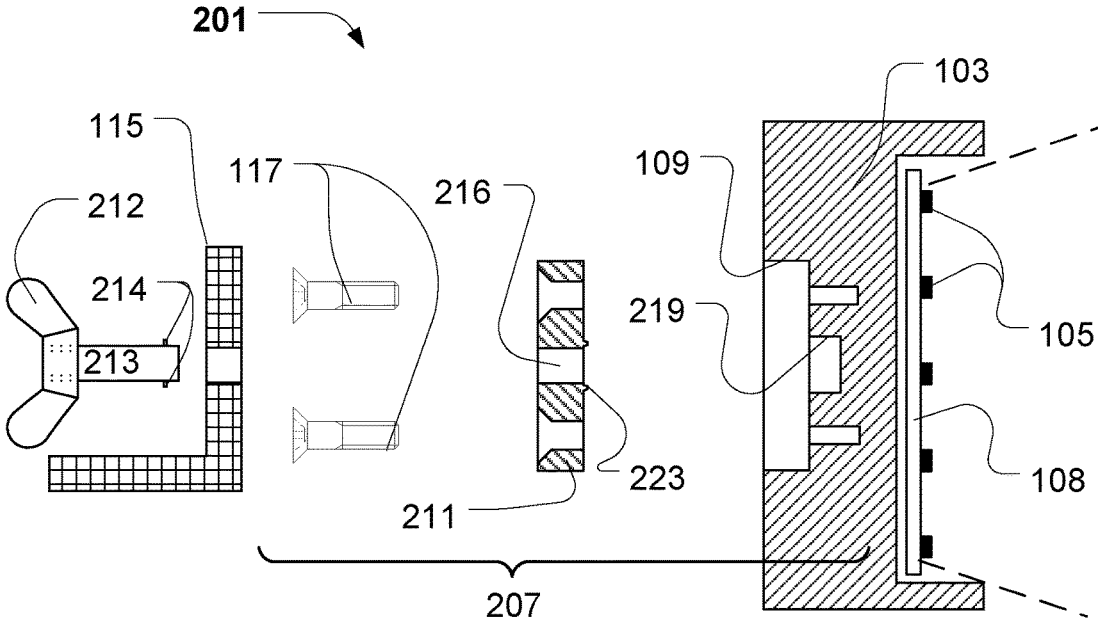

FIGS. 2A-B illustrate a structural cross sectional and an exploded cross sectional view of another embodiment of a light fixture 201 comprising an attachment assembly 207 according to the present invention. The light fixture 201 is similar to the light fixture 101 illustrated in FIGS. 1A and 1B and identical components are labeled with the same references as in FIGS. 1A and 1B and will not be described further in connection with FIGS. 2A and 2B. FIGS. 2A and 2B serve to illustrate further aspects of the invention according to the present invention and it is to be understood that the illustrated principles can be combined with any of the illustrated embodiments.

In this embodiment, the mating member 213 has been provided as a locking rod with a wing head 212 where the rod comprises locking pins 214 protruding from the rod. The fastening plate 211 has been provided with a locking member 225 configured to lock with the locking pins upon rotation of the locking rod inside the attachment assembly. The fastening plate has thus been provided with an opening 216 enabling insertion of the locking rod at one angular position and which prevents extraction for the locking rod another angular positions. The locking rods and locking member 225 can for instance be provided using the principles of a standard quarters turn widely used in the field of stage lighting. For instance, using principles shown in U.S. Pat. No. D225,772.

In this embodiment, the alcove 109 comprises a mating recess 219 formed in a bottom part of the alcove 109 and the mating recess 219 is configured to receive at least a part of the mating member 213. The mating recess 219 makes it possible to let the mating member 213 extend through the fastening plate 211 and while the fastening plate 211 can still be secured inside the alcove 109 as the bottom surface of the alcove 109 which surrounds the mating recess 219 supports the remaining part of the fastening plate 211, and the self-tapping screws can also be screwed into this part of the bottom of the alcove 109.

Figure 3A:
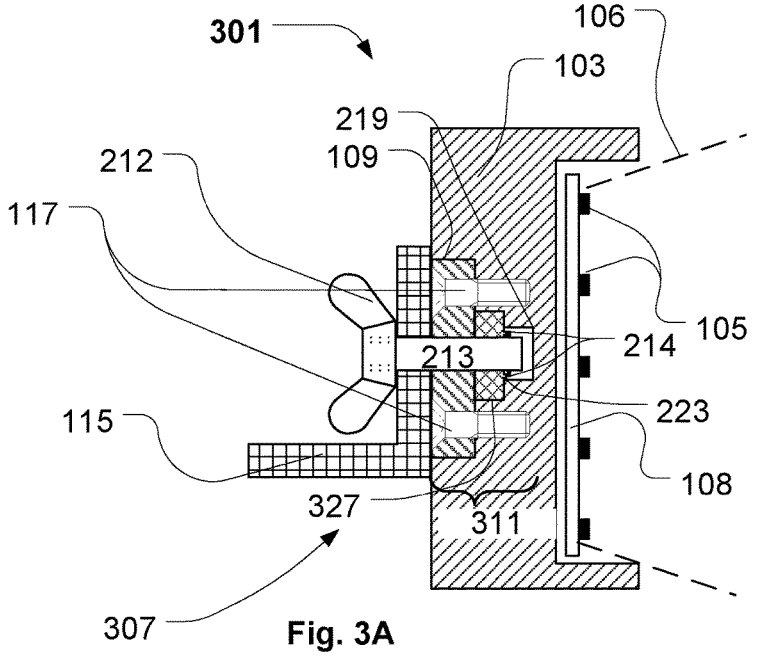
FIGS. 3A-B illustrate a structural cross sectional and an exploded cross sectional view of a light fixture comprising an attachment assembly according to the present invention.
Figure 3B:
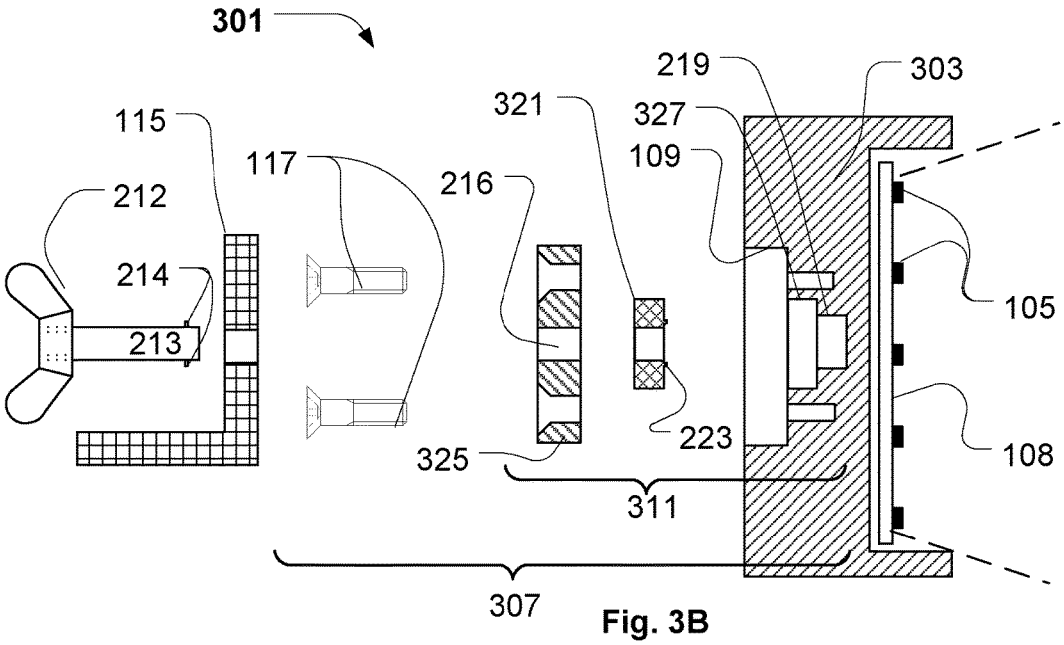

FIGS. 3A-B illustrate a structural cross sectional and an exploded cross sectional view of another embodiment of a light fixture 301 comprising an attachment assembly 307 according the present invention. The light fixture 301 is similar to the light fixtures 101, 201 illustrated in FIGS. 1A-B and 2A-B and 2B and identical components are labeled with the same references as in FIGS. 1A-B and 2A-B and will not be described further in connection with FIGS. 3A and 3B. FIGS. 3A and 3B serve to illustrate further aspects of the invention according to the present invention and it is to be understood the illustrated principles can be combined with any of the illustrated embodiments.

In this embodiment, the light fixture 301 comprises a fastening unit 311 comprising a locking plate 321 and a top plate 325 where the locking plate 321 is arranged below the top plate 325 and comprises locking members 223 configured to lock with the mating member 213. The locking members 223 have been provided as described in connection with FIG. 2A and FIG. 2B. Providing a top plate 325 and a locking plate 321 as separate components makes it possible to avoid that the self-tapping screws are worn out in time and thereby reduce the risk that the fasting unit 311 will fall out. This is avoided due to the fact that the amount of force applied to the self-tapping screws when locking the mating member to the light fixtures is reduced as less force can be transferred between the locking plate and the top plate when they are separated.

In this embodiment, the alcove 109 comprises a support recess 327 formed in a bottom part of the alcove 109 and the support recess 327 is configured to accommodate the locking plate 321. The side walls of the support recess 327 will support the locking plate 321 and provide a stable arrangement of the locking plate 321 inside the alcove 109. The top plate 325 can be secured inside the alcove 109 as the bottom surface of the alcove 109 surrounding support recess supports the remaining part of the locking plate 321 and the self-tapping screws can also be screwed into this part of the bottom of the alcove 109.

In this embodiment, the mating recess 219 is similar to the one described in connection with FIGS. 2A and 2B and is formed in a bottom part of support recess 327. The alcove 109 comprises thus a stepped bottom where the mating recess forms the deepest bottom part, the support recess 327 forms the middle bottom part and the alcove 109 bottom forms an upper bottom part.

Compared with FIGS. 2A and 2B, the length of mating member 213 is configured to add depth to the fastening unit 311. However it is also noticed that the thickness of the components of the fastening units can be provided to fit the length of standard mating members.

In alternative embodiment, the support recess 327 can also be omitted and the top plate 325 and locking plate 321 can then both be arranged in the same alcove cavity. In such embodiment, the locking plate 321 comprises openings enabling the self-taping screws to extend through the locking plate 321.

In alternative embodiment, the mating recess can be omitted and the locking plate 321 can be provided with a threaded hole wherein a locking threaded blot can be screwed.

It is noticed that the principles of providing a light fixture with a lamp housing comprising a light source in a cavity which is configured to emit light out of the lamp housing; where an attachment assembly comprises an alcove formed in an outer surface of the housing shell; where the alcove is configured to accommodating a fastening unit configured to receive and lock with a mating member of a support structure; where the fastening unit comprises a locking plate configured to lock with the mating member and a top plate arranged above the locking plate; where the locking plate is arranged in a support recess formed in a bottom part of the alcove can be provided in any kind of lamp housing shell formed in any kind of material. Additionally, these principles can also be provided in embodiments where the fastening unit is secured inside the alcove using other kinds of fastening mechanisms instead of or alternatively to the self-tapping screws described above. For instance, by adhesive or glue, by using a bolt screwed into a nut arranged inside the cavity of the light fixture.

Similarly it is noticed that the principles of providing a light fixture with a lamp housing comprising a light source in a cavity which is configured to emit light out of the lamp housing; where an attachment assembly comprises an alcove formed in an outer surface of the housing shell; where the alcove is configured to accommodating a fastening unit configured to receive and lock with a mating member of a support structure; where a mating recess is formed in a bottom part of the alcove and where the mating recess is configured to receive at least a part of the mating member can be provided in any kind of lamp housing shell formed in any kind of material.

Figure 4:
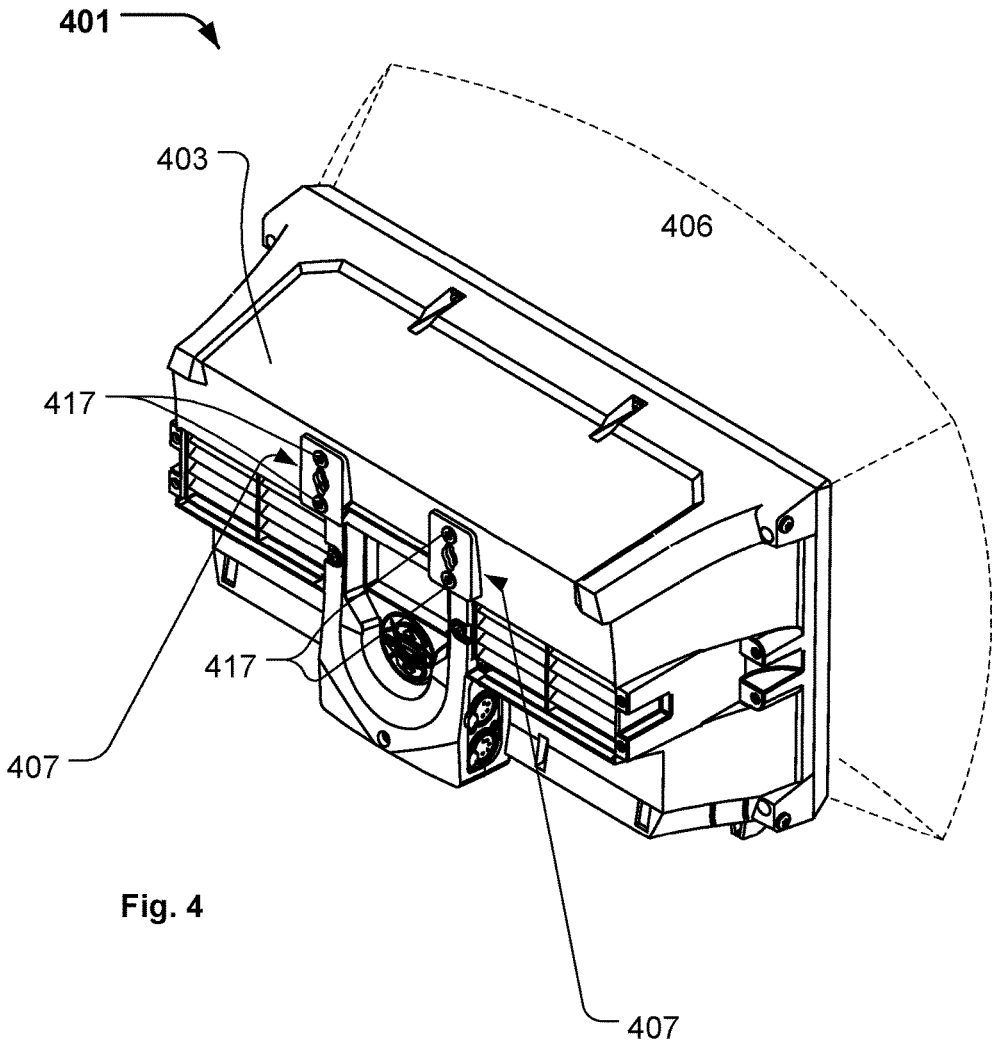
FIG. 4 illustrates a back perspective view of a light fixture comprising an attachment assembly according to the present invention.
Figure 5:
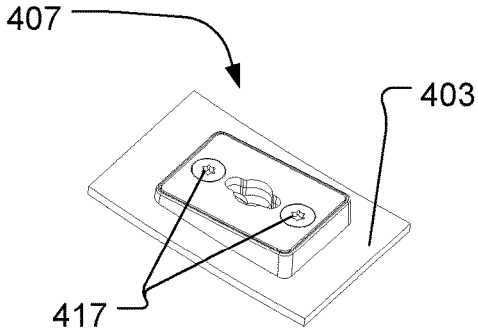
FIG. 5 illustrates an attachment assembly of a light fixture according to the present invention.
Figure 6A:
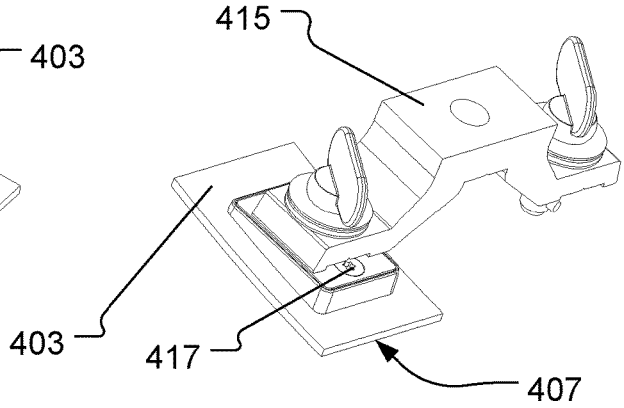
FIGS. 6A-6H illustrate different views of an attachment assembly of a light fixture together with a omega bracket.
Figure 6B:
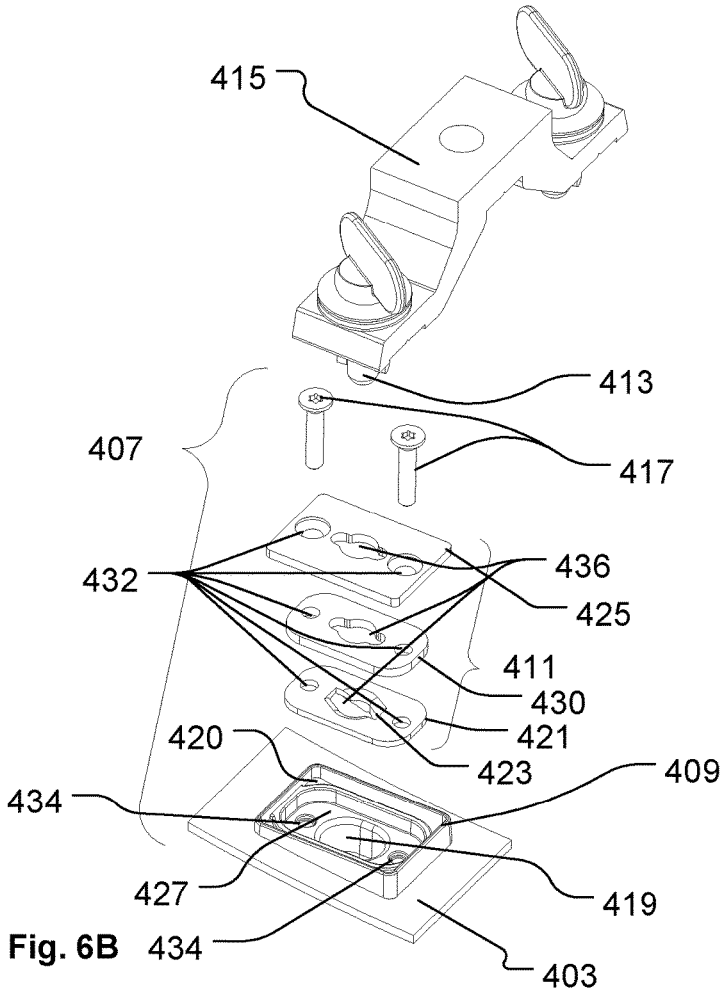
Figure 6C:
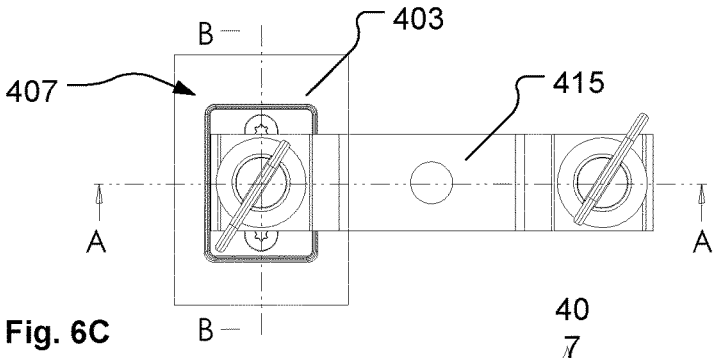
Figure 6D:
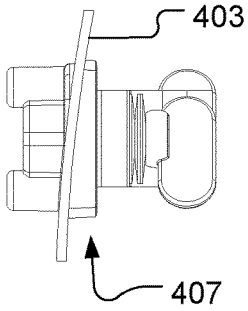
Figure 6E:
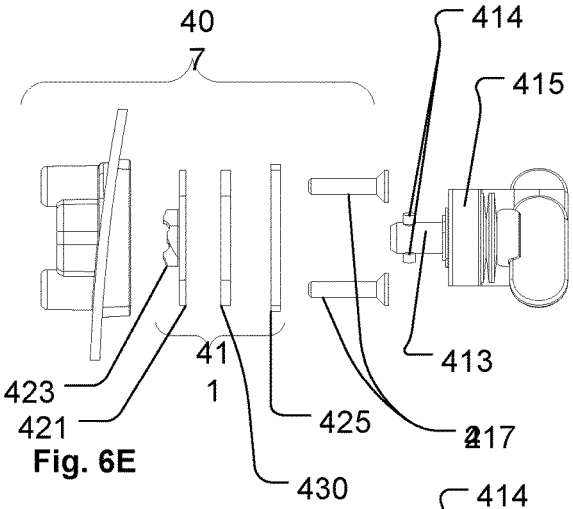
Figure 6F:
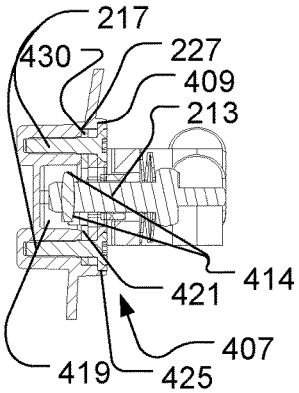
Figure 6G:
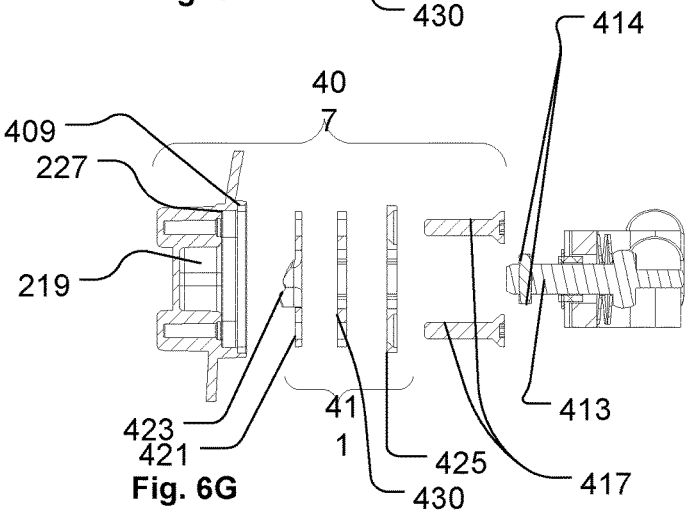
Figure 6H:
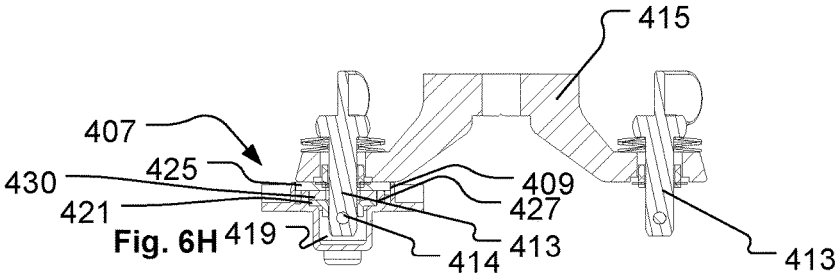

FIG. 4 illustrates a back perspective view of a light fixture 401 comprising an attachment assembly 407 according to the present invention, FIG. 5 illustrates a perspective view of the attachment assembly 407 and FIGS. 6A-6B illustrate different views of the attachment assembly 407 together with a omega bracket 415. Where FIG. 6A illustrates a perspective view, FIG. 6B illustrates an exploded perspective view, FIG. 6C illustrates a top view, FIG. 6D illustrates a side view, FIG. 6E illustrates an exploded side view, FIG. 6F illustrates a cross sectional view through line B-B, FIG. 6G illustrates an exploded cross sectional view through line B-B and FIG. 6H illustrates a cross sectional view through line A-A.

The light fixture 401 is similar to the light fixtures 101, 201, 301 illustrated in the previous figures and similar components providing similar effects are labeled with the same last two digits as in the previous figures.

The light fixture 401 comprises lamp housing including a polymer housing shell 403 forming a cavity (not visible), wherein at least one light source (not visible) generating light 406 is arranged. The lamp housing comprises two attachment assemblies 407 arranged at the back surface of the polymer housing shell 403. The attachment assemblies 407 are arranged at a mutual distance enabling the light fixture 401 to be stitched to a standard omega bracket 415 (shown in FIGS. 6A-H).

In FIGS. 5 and 6A-H, each of the attachment assemblies 407 comprise an alcove 409 formed in the outer surface of the polymer housing shell 403. The alcove 409 is configured to accommodating a fastening unit 411. The alcove 409 is configured to partially protrude from the surface of the polymer housing shells 403. The alcove 409 comprises a stepped bottom where a mating recess 419 forms the deepest bottom part, a support recess 427 forms the middle bottom part and the alcove 409 bottom 420 forms an upper bottom part.

A fastening unit 411 is configured to receive and lock with a mating member 413 of a support structure 415. The mating member 413 is formed as a standard quarter turn lock and the support structure 415 as a standard omega bracket known from the stage lighting industry. The fastening unit 411 comprises a locking plate 421 and a top plate 425 where the locking plate 421 is arranged below the top plate 425. The locking plate 421 comprises locking members 423 configured to lock with the locking pins 414 of the mating member 413 upon rotation of the mating member 413. The fastening unit 411 comprises also a spacer plate 430 provided in order to fit the length of the fastening unit 411 to the length of the standard quarter turn locking pin 413. The locking plate 421 and the spacer plate 431 are configured to fit into the support recess 427 and top plate 425 is configured to fit into the upper part of the alcove 409.

The mating recess 419 is configured to receive at least a part of the mating member 413 and a part of the locking member 423 of the locking plate 421.

The fastening unit 411 is secured to the polymer housing shell by two self-tapping screws 417 configured to drill itself into a part of the polymer housing shell 403. The self-tapping screws extend through openings 432 in the top plate 425, the spacer plate 423 and a locking plate 421 and drilled them self into corresponding drill holes in the bottom surface of the support recess 427.

Additionally, the top plate, the spacer plate, and the locking plate comprise an opening 436 enabling insertion of the locking pins 414 of the mating member 413.

The invention claimed is:

1. A light fixture comprising:

a light source arranged in a lamp housing; the lamp housing comprising a housing shell forming a cavity wherein the light source is arranged and configured to emit light out of the lamp housing, the lamp housing comprises an attachment assembly comprising an alcove formed in an outer surface of the housing shell, wherein the alcove is configured to accommodate a fastening unit, the fastening unit is configured to receive a mating member connected to a support structure and the mating member can be locked to the fastening unit, and wherein the fastening unit comprises a locking plate and a top plate and where the locking plate is arranged below the top plate and includes a locking member configured to lock with the mating member.

2. The light fixture of claim 1, wherein the alcove comprises a mating recess formed in a bottom part thereof, where the mating recess is configured to receive at least a part of the mating member.

3. The light fixture of claim 1, wherein the alcove comprises a support recess formed in a bottom part thereof, where the support recess is configured to accommodate the locking plate.

4. The light fixture of claim 3, wherein a mating recess is formed in a bottom part of the support recess.

5. The light fixture of claim 1, wherein the fastening unit comprises a quarter turn lock.

6. The light fixture of claim 1, wherein the housing shell is formed as a polymer housing shell and the fastening unit is secured to the polymer housing shell by a self-tapping screw configured to be drilled into a part of the polymer housing shell.

7. The light fixture of claim 1, wherein the fastening unit is formed as a fastening plate configured to fit into the alcove such that side walls of the alcove support the fastening plate.

8. The light fixture of claim 1, wherein a depth of the alcove is configured to accommodate the fastening unit such that the fastening unit is entirely kept inside the alcove.

9. The light fixture of claim 1, wherein the alcove is provided as a recess in a polymer housing shell and a surface of the polymer housing shell and a surface of a fastening unit forms a flat surface.

10. The light fixture of claim 9, wherein the alcove is configured to partially protrude from the surface of the polymer housing shell.

11. A light fixture system comprising the light fixture of claim 1 and at least one support structure comprising the mating member.

12. The light fixture system of claim 11 wherein the mating member comprises a locking rod configured to lock with the fastening unit upon rotation of the locking rod.

13. The light fixture system of claim 11, wherein the mating member is formed as a bolt and the fastening unit comprises a threaded hole wherein the bolt can be screwed.

14. The light fixture system of claim 11, wherein the at least one support structure is formed as a standard omega bracket and the lamp housing comprises two attachment assemblies arranged at a mutual distance enabling the light fixture to be stitched to the standard omega bracket.

15. A light fixture comprising:

a lamp housing including an attachment assembly and a housing shell that forms a cavity, wherein the attachment assembly includes an alcove formed in an outer surface of the housing shell to accommodate a fastening unit, a light source arranged in the lamp housing and being configured to emit light; and a mating member for being received by the fastening unit and being connected to a support structure that locks the mating member to the fastening unit, wherein the fastening unit comprises a locking plate and a top plate and wherein the locking plate is arranged below the top plate and includes a locking member configured to lock with the mating member.

16. The light fixture of claim 15, wherein the alcove comprises a mating recess formed in a bottom part thereof, wherein the mating recess is configured to receive at least a part of the mating member.

17. The light fixture of claim 15, wherein the alcove comprises a support recess formed in a bottom part thereof, where the support recess is configured to accommodate the locking plate.

18. A light fixture comprising:

a light source;

a lamp housing including an attachment assembly, a housing shell that forms a cavity, and the light source, wherein the attachment assembly includes an alcove formed in an outer surface of the housing shell to accommodate a fastening unit;

a mating member for being received by the fastening unit and being connected to a support structure that locks the mating member to the fastening unit; and wherein the fastening unit comprises a locking plate and a top plate and where the locking plate is arranged below the top plate and includes a locking member configured to lock with the mating member.

* * * * *